US009748709B2

(12) United States Patent
Byrne et al.

(10) Patent No.: US 9,748,709 B2
(45) Date of Patent: Aug. 29, 2017

(54) GROMMET-MOUNT ELECTRICAL POWER UNIT ASSEMBLY

(71) Applicants: Norman R. Byrne, Ada, MI (US); Thomas A. Petersen, Sand Lake, MI (US); Randell E. Pate, Jenison, MI (US); E. Stephan Winkelmann, Rockford, MI (US)

(72) Inventors: Norman R. Byrne, Ada, MI (US); Thomas A. Petersen, Sand Lake, MI (US); Randell E. Pate, Jenison, MI (US); E. Stephan Winkelmann, Rockford, MI (US)

( * ) Notice: Subject to any disclaimer, the term of this patent is extended or adjusted under 35 U.S.C. 154(b) by 0 days.

(21) Appl. No.: 15/079,982

(22) Filed: Mar. 24, 2016

(65) Prior Publication Data

US 2016/0294128 A1 Oct. 6, 2016

Related U.S. Application Data

(60) Provisional application No. 62/140,791, filed on Mar. 31, 2015.

(51) Int. Cl.

| | |
|---|---|
| ***H01R 13/60*** | (2006.01) |
| ***H01R 13/66*** | (2006.01) |
| ***H01R 13/74*** | (2006.01) |

(52) U.S. Cl.

CPC .... *H01R 13/746* (2013.01); *A47B 2200/0082* (2013.01)

(58) Field of Classification Search

CPC ..... H01R 35/04; H01R 13/44; H01R 13/746; H01R 13/502; B65D 25/24; B65D 25/02

USPC ..... 439/538, 539, 271, 925, 131, 465, 551, 439/543, 571; 174/48, 482

See application file for complete search history.

(56) References Cited

U.S. PATENT DOCUMENTS

| | | | | |
|---|---|---|---|---|
| 3,622,684 | A | 11/1971 | Press | |
| 4,005,922 | A * | 2/1977 | Burkhart | H01R 13/512 439/465 |
| 4,453,059 | A | 6/1984 | Fukushima | |
| 5,705,772 | A | 1/1998 | Brown | |
| D399,826 | S | 10/1998 | Byrne | |
| 5,888,093 | A | 3/1999 | Polgar et al. | |

(Continued)

FOREIGN PATENT DOCUMENTS

| | | |
|---|---|---|
| JP | 6-30515 | 2/1994 |

*Primary Examiner* — Hae Moon Hyeon

(74) *Attorney, Agent, or Firm* — Gardner, Linn, Burkhart & Flory, LLP

(57) ABSTRACT

An electrical receptacle assembly is mountable at an opening in a work surface to provide convenient access to electrical power and/or data. The assembly includes a main housing and a housing shell. The main housing defines an interior cavity for receiving a lower portion of an electrical or data outlet, and has an outlet opening in which a face of the electrical or data outlet is supported. The housing shell is coupled to the main housing and surrounds at least a portion of the interior cavity. Respective outer surfaces of the main housing and the housing shell cooperate to form an outer surface of the two-piece housing that is insertable into the opening in the work surface. A fastener, which may be an internally threaded collar, engages the two-piece housing, which may be externally threaded, and also engages the work surface, to secure the assembly to the work surface.

20 Claims, 10 Drawing Sheets

(56) References Cited

U.S. PATENT DOCUMENTS

| | | | | |
|---|---|---|---|---|
| 6,024,599 | A | 2/2000 | Stathis et al. | |
| 6,081,356 | A | 6/2000 | Branc et al. | |
| 6,307,152 | B1 | 10/2001 | Bonilla et al. | |
| D484,096 | S * | 12/2003 | Mackin | D13/138.2 |
| 6,805,578 | B2 * | 10/2004 | Chiou | H01R 13/5812 439/469 |
| 6,923,684 | B2 | 8/2005 | Strayer | |
| 6,969,800 | B1 | 11/2005 | Liao | |
| 7,053,296 | B2 | 5/2006 | Drane et al. | |
| D537,039 | S | 2/2007 | Pincek | |
| 7,559,795 | B2 | 7/2009 | Byrne | |
| 7,614,889 | B1 | 11/2009 | Black et al. | |
| 7,806,723 | B2 * | 10/2010 | Chong | H02G 3/22 439/571 |
| 8,007,295 | B2 | 8/2011 | Lin | |
| D647,853 | S | 11/2011 | Kan | |
| 8,277,233 | B2 | 10/2012 | Su | |
| D714,726 | S * | 10/2014 | Byrne | D13/137.1 |
| D717,732 | S | 11/2014 | Byrne et al. | |
| 8,987,642 | B2 | 3/2015 | Byrne | |
| 9,024,211 | B2 * | 5/2015 | Stathis | H02G 3/0406 16/2.1 |
| D739,821 | S | 9/2015 | Byrne et al. | |
| 9,148,006 | B2 | 9/2015 | Byrne et al. | |
| D741,266 | S * | 10/2015 | Byrne | D13/138.2 |
| D744,953 | S | 12/2015 | Byrne et al. | |
| 9,312,653 | B2 * | 4/2016 | Byrne | H01R 27/02 |
| 9,312,673 | B2 | 4/2016 | Byrne et al. | |
| 9,368,924 | B2 | 6/2016 | Byrne et al. | |
| D762,176 | S | 7/2016 | Byrne et al. | |
| 2006/0258195 | A1 | 11/2006 | Schwartz et al. | |
| 2015/0295375 | A1 * | 10/2015 | Byrne | H01R 27/02 439/131 |

* cited by examiner

GROMMET-MOUNT ELECTRICAL POWER UNIT ASSEMBLY

CROSS REFERENCE TO RELATED APPLICATION

The present application claims the benefit of U.S. provisional application Ser. No. 62/140,791 , filed Mar. 31, 2015, which is hereby incorporated by reference in its entirety.

FIELD OF THE INVENTION

The present invention relates to electrical power outlets and, more particularly, to electrical power units having one or more outlets and mountable in an opening formed in a work surface or the like.

BACKGROUND OF THE INVENTION

Electrical power outlets and/or electronic data outlets are commonly provided at or near work surfaces for use by persons located at near the work surface. In some cases the outlets are mounted below the work surface, which may be a table or desk, while in other arrangements the outlets are mounted and accessible at a location above the work surface, and in still other arrangements, a power unit having one or more outlets may be mounted at least partially in an opening formed in the work surface.

SUMMARY OF THE INVENTION

The present invention provides a grommet-style electrical power unit assembly that can be readily coupled to the work surface at an opening formed therein, and which is configured to support different types of electrical and/or data outlets at the work surface. The unit includes a housing that can be assembled from two housing pieces, one of which supports the outlet and includes an outer surface that facilitates mounting the unit to the work surface, and the other of which can include an upper bezel that rests atop the work surface and provides another outer surface portion that facilitates attachment of the unit to the work surface. The housing pieces (and in some cases, the entire electrical power unit) can be assembled and disassembled without the use of fasteners or tools, which facilitates assembly and also facilitates changing one outlet for another, as desired.

According to one form of the present invention, a grommet-style electrical receptacle assembly includes first and second housing pieces that assemble together, and a fastener for securing the housing pieces at an opening formed in a table or other work surface. The first housing piece has a first base portion and a first upper portion that is configured to support an electrical or data outlet. The second housing piece has a second base portion and a second upper portion, the upper portion including a bezel substantially surrounding an upper part of the electrical or data outlet. One or both of the base portions substantially enclose and define an interior cavity that receives at least a lower portion of the electrical or data outlet.

In one aspect, the first and second housing pieces share a common longitudinal axis when they are assembled together, and have respective vertical edge portions that are disposed along a common plane that is substantially parallel to, and may intersect, the longitudinal axis.

In another aspect, the first base portion has a threaded half cylindrical part and a non-threaded half cylindrical part, where the threaded and non-threaded half cylindrical parts cooperate to define the interior cavity. The second base portion includes its own threaded half cylindrical part that is positionable around the non-threaded half cylindrical part, and cooperatively aligns with the threaded half cylindrical part of the first base portion. Optionally, the fastener is a threaded collar for threadingly engaging the threaded half cylindrical portions of the first and second base portions. The fastener has an upper surface that engages a lower surface of the work surface.

According to another form of the present invention, an electrical receptacle assembly is configured for mounting at an opening in a work surface, and includes a two-piece housing made up of a main housing and a housing shell, and a fastener for securing the electrical receptacle assembly to the work surface. The main housing defines an interior cavity for receiving at least a lower portion of an electrical or data outlet, and further includes or defines an outlet opening in which the electrical or data outlet can be mounted. The housing shell is coupled to the main housing and is disposed around at least a portion of the interior cavity. Respective outer surface portions of the main housing and the housing shell cooperate to form an outer surface of the two-piece housing, which is configured for insertion into the opening of the work surface. The fastener engages the outer surface of the two-piece housing, and further engages the work surface, to thereby secure the receptacle assembly to the work surface.

In one aspect, the housing shell includes an upper bezel that is positioned or disposed generally around the outlet opening of the main housing.

In another aspect, each of the outer surface portions of the main housing and the housing shell include respective sets of partial male threads. When the housing shell is coupled to the main housing, the partial male threads cooperate to define a substantially continuous male thread around the outer surface of the two-piece housing.

In a further aspect, the fastener is a threaded collar for threadingly engaging the substantially continuous male thread, and the fastener includes an upper portion that is configured to engage a lower surface of the work surface.

Thus, the electrical receptacle assembly of the present invention is readily mountable to an opening formed or established in a work surface or the like, and provides users with access to electrical and/or data outlets at the work surface. The unit can be readily disassembled, such as for changing to a different style or type of outlet, and reassembled and reattached to the work surface. The power unit may be manually assembled and disassembled, or simply detached from one surface and readily moved to another, substantially without the use of tools.

These and other objects, advantages, purposes and features of the present invention will become apparent upon review of the following specification in conjunction with the drawings.

DESCRIPTION OF THE PREFERRED EMBODIMENTS

Figure 1:
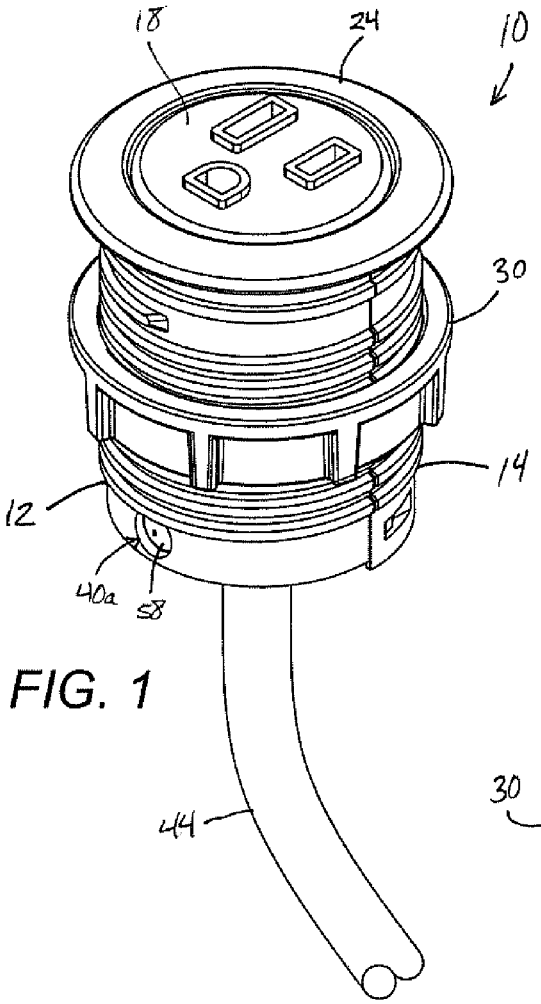
FIG. 1 is a perspective view of a grommet-style electrical receptacle assembly in accordance with the present invention, shown fitted with a 110 volt AC receptacle.
Figure 2:
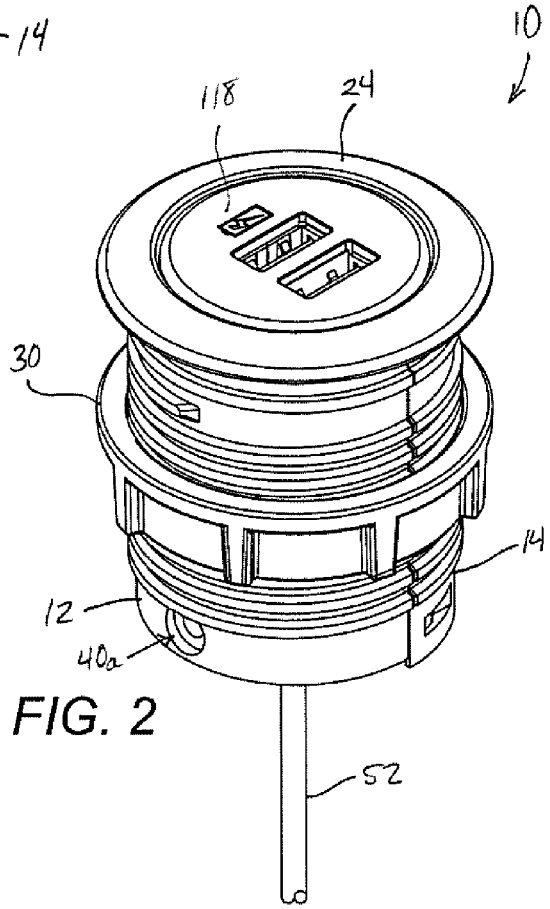
FIG. 2 is a perspective view of another grommet-style electrical receptacle assembly in accordance with the present invention, shown fitted with a dual-receptacle low voltage USB-style outlet.
Figure 16:
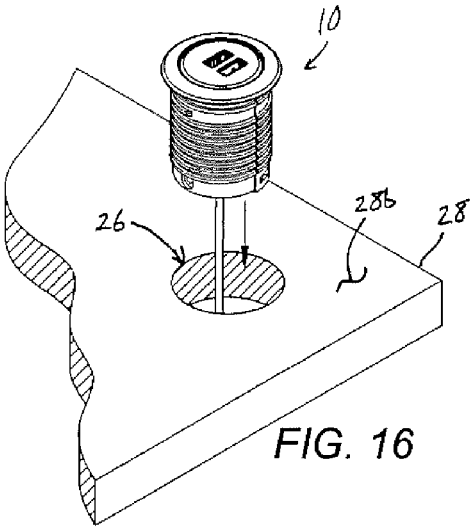
Figure 18:
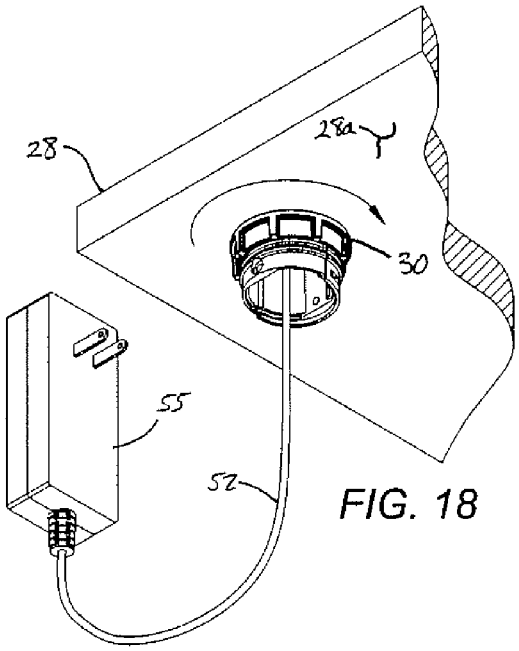
Figure 17:
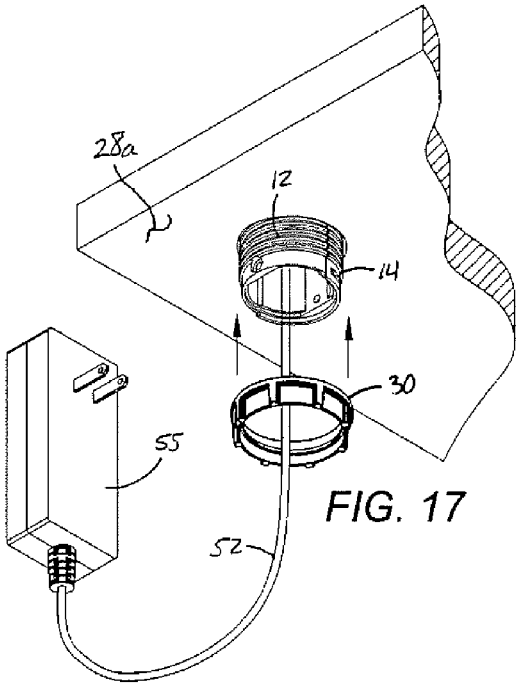
Figure 19:
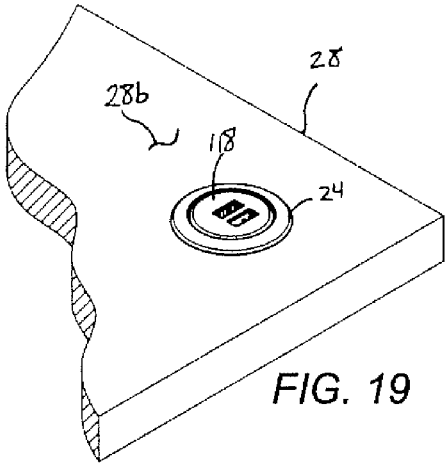

Referring now to the drawings and the illustrative embodiments depicted therein, a grommet-style electrical receptacle assembly 10 is constructed from a two-piece housing including a first or main housing piece 12 and a second housing piece or housing shell 14 (FIGS. 1 and 2). As best shown in FIGS. 3, 5C, 6, 10 and 12, main housing 12 defines an interior cavity 16 that receives a lower portion 18*a* of an electrical outlet 18, through an opening 20 formed in an upper surface 22 (FIG. 6) of main housing 12. Housing shell 14 includes an upper portion 14*b* having an upper bezel 24 that overlies main housing 12 and substantially surrounds an upper portion 18*b* of electrical outlet 18 upon assembly. Once main housing 12 and housing shell 14 are assembled together (FIGS. 4, 5 and 16), they are ready for insertion into an opening 26 that is formed or established in a work surface 28 (FIGS. 13-16), such as a desk, table, divider wall, shelving unit, or the like. Upon insertion of the lower portions of main housing 12 and housing shell 14 into opening 26, bezel 24 rests atop work surface 28 so that electrical outlet 18 will be accessible at work surface 28 and to permit a fastener such as a threaded collar 30 to secure the assembly to the work surface, such as shown in FIGS. 17-19. It will be appreciated that throughout the description, terms such as "upper", "lower", "above", "below", "overlie", and the like are used for convenience in identifying relative locations of various components and surfaces relative to one another in reference to the drawings, and the assembly may be installed and used in substantially any orientation so that these terms are not intended to be limiting in any way.

Figure 5A:
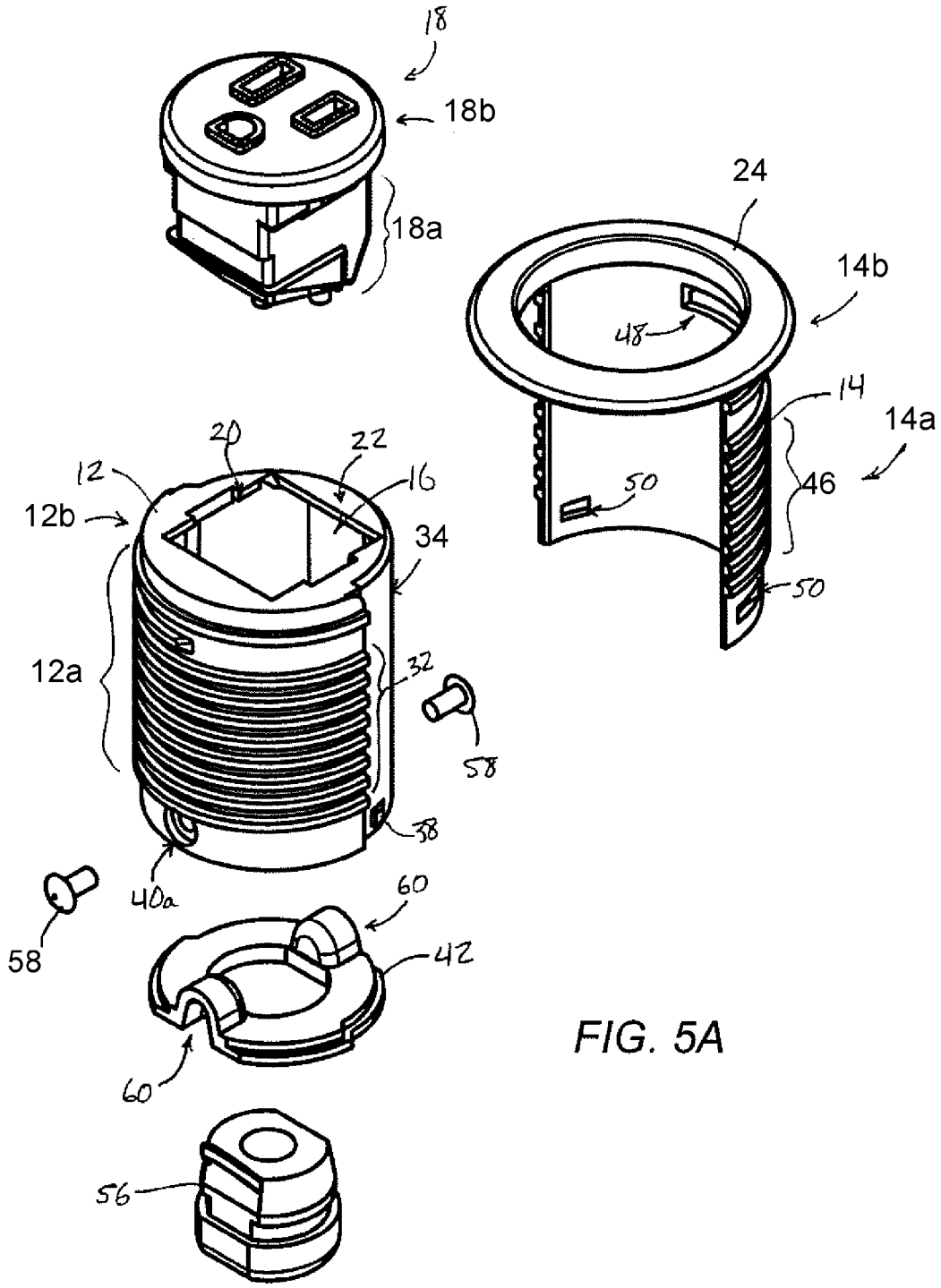
FIG. 5A is an exploded perspective view of the electrical receptacle assembly of FIG. 5.
Figure 5B:
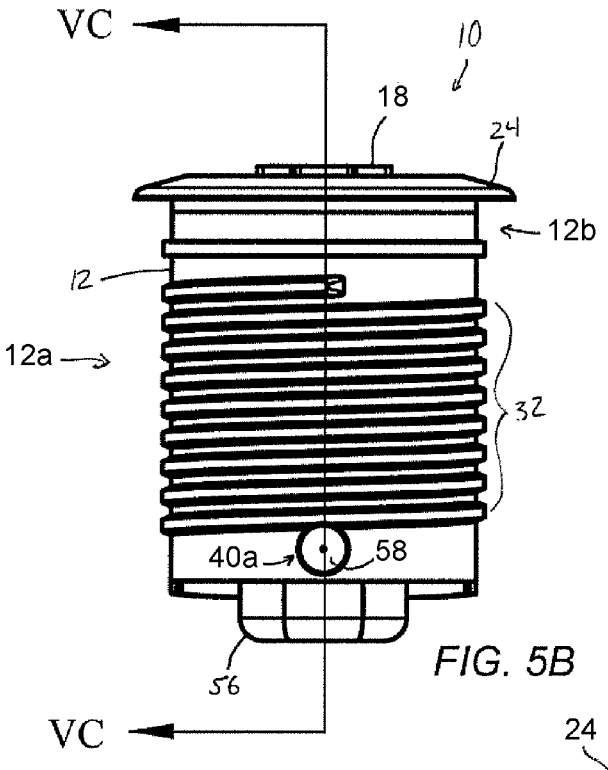
FIG. 5B is a side elevation of the electrical receptacle assembly of FIG. 5A.
Figure 6:
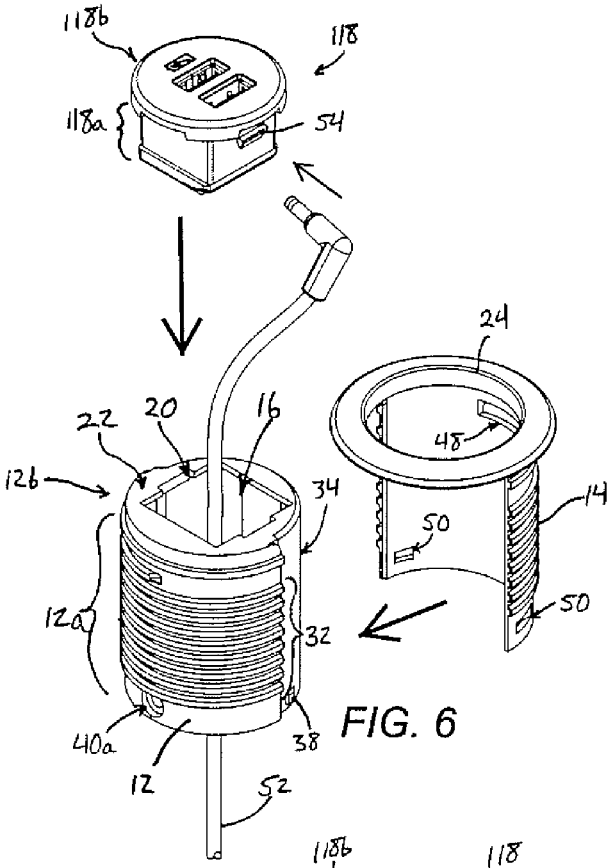
FIG. 6 is an exploded perspective view of the electrical receptacle assembly of FIG. 2, depicting three assembly steps.
Figure 8:
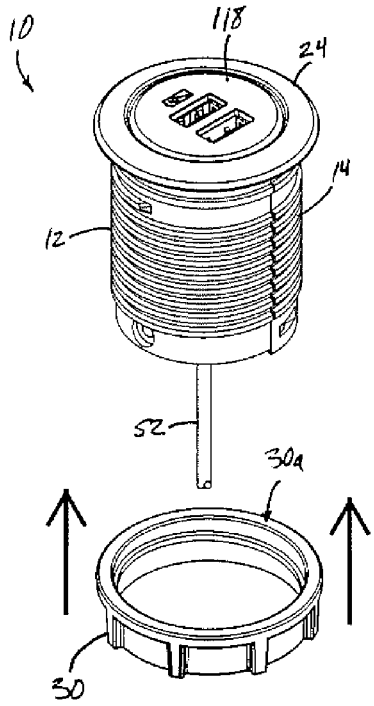
FIG. 8 is perspective view of the electrical receptacle assembly of FIGS. 6 and 7, depicting a step of attaching a threaded collar to the assembled housings.
Figure 7:
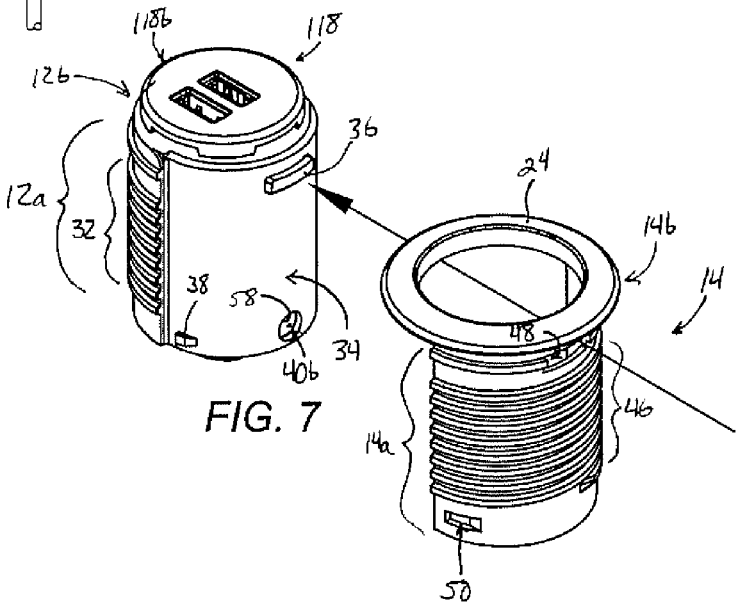
FIG. 7 is another partially exploded perspective view of the electrical receptacle assembly of FIG. 6, shown rotated approximately 90-degrees about its vertical axis as compared to FIG. 6, and shown prior to attachment of the housing shell.
Figure 9:
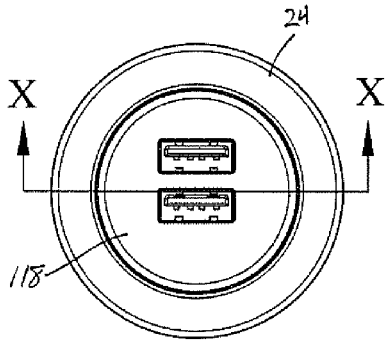
FIG. 9 is a top plan view of the electrical receptacle assembly of FIG. 2.

Electrical receptacle assembly 10 may be fitted or equipped with a high voltage Alternating Current (AC) power outlet, such as 110 volt AC "simplex" outlet as shown in FIG. 1, or a low voltage Direct Current (DC) power outlet, such as a Universal Serial Bus (USB)-style dual-receptacle outlet as shown in FIG. 2, both of which are designated with reference numeral 18 in the drawings. It will be appreciated that the identical main housing 12 and housing shell 14 may be used with either type of electrical outlet, or still other types of electrical and/or data outlets, as will be described below. Main housing 12 includes a lower or base portion 12*a* that is generally cylindrical in shape, such as shown in FIGS. 3, 5A, 6 and 7, and has an upper end portion 12*b*terminating at upper surface 22 (FIG. 6). The main housing's lower portion 12*a* includes two distinct outer surface portions, including a semi-cylindrical male threaded portion 32 having a relatively larger outer diameter, and a semi-cylindrical smooth portion 34 having a relatively smaller outer diameter, such as shown in FIGS. 6 and 7. It is envisioned that main housing 12, including lower portion 12*a*, upper portion 12*b*, threaded portion 32, and smooth portion 34, can be unitarily formed, such as of resinous plastic in an injection molding operation. However, it will be appreciated that threaded portion 32 and smooth portion 34 may be formed separately and later joined, and in that case the upper surface 22 could formed as a separate component, or could be unitarily formed with either threaded portion 32 or smooth portion 34.

In the illustrated embodiment, and as shown in FIG. 7, smooth portion 34 of the main housing's lower portion 12*a* includes an alignment element in the form of elongate tab or projection 36 near the main housing's upper portion 12*b*. Smooth portion 34 further includes latching elements in the form of a pair of ramped latch projections 38 at a lower end of lower portion 12*a*, proximate threaded portion 32. As will be described below in more detail, tab 36 and latch projections 38 cooperate with corresponding openings formed in housing shell 14 to align and secure housing shell 14 to main housing 12. Optionally, a pair of openings 40*a*, 40*b* are formed or established at a lower end of main housing 12, located across from one another, to facilitate the use of fasteners to secure an optional base plate 42 (FIGS. 5-5C) that is used to limit or preclude access to exposed conductors associated with outlet 18 and to provide a strain relief for a high voltage power cord 44.

Figure 4:
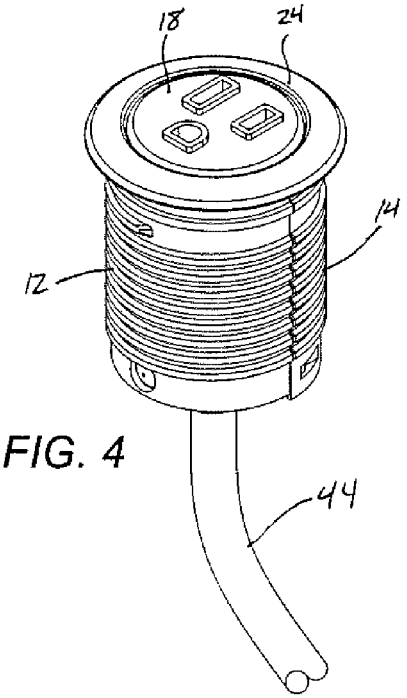
FIG. 4 is another perspective view of the electrical receptacle assembly of FIG. 1, shown without the threaded collar fastener.
Figure 5:
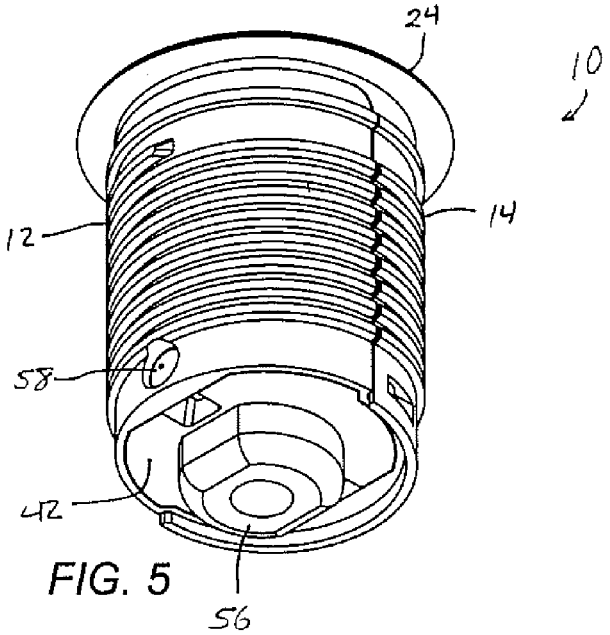
FIG. 5 is a bottom perspective view of the electrical receptacle assembly of FIG. 4, in which the power cord is omitted for clarity.
Figure 10:
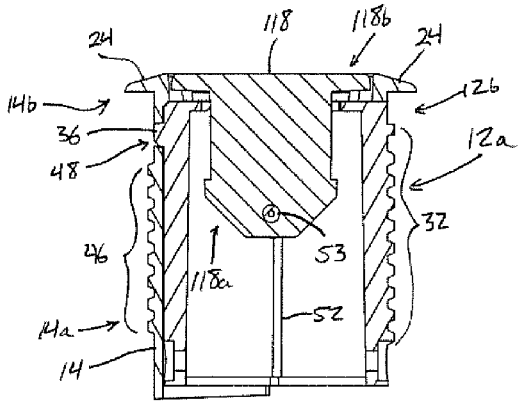
FIG. 10 is a side sectional elevation taken through section line X-X of FIG. 9.
Figure 11:
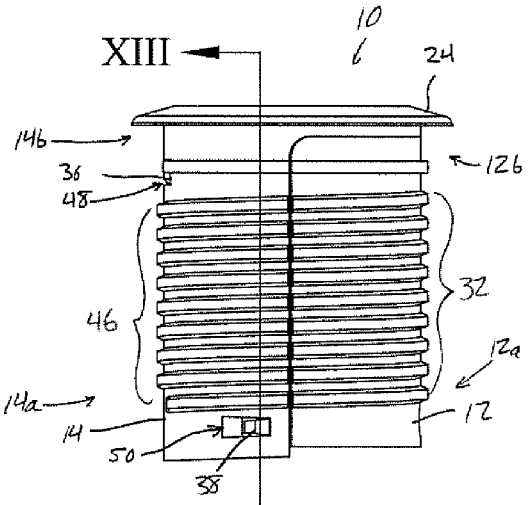
FIG. 11 is a side elevation of the electrical receptacle assembly of FIG. 2, in which the threaded collar is removed.
Figure 12:
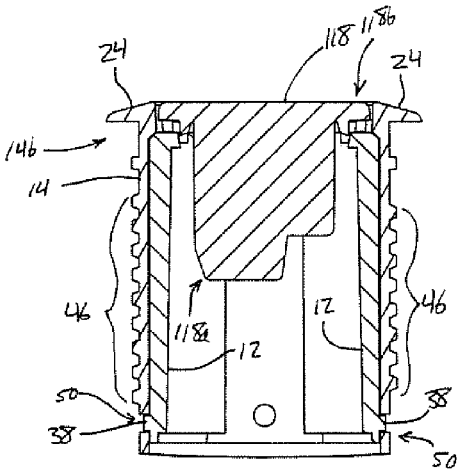
FIG. 12 is a side sectional elevation taken along section line XII-XII of FIG. 11.

Housing shell 14 includes a lower or base portion 14*a* that is semi-cylindrical in shape, and which has a convex outer surface having semi-cylindrical male threads 46 that substantially align with threaded portion 32 of the main housing's lower portion 12*a*, such as shown in FIGS. 4, 5 and 11. The housing shell's lower portion 14*a* further includes an alignment element in the form of an upper slot 48 that is sized and shaped to receive tab 36, and a pair of latching elements in the form of lower openings or slots 50 that are configured to receive respective ones of the latch projections 38 upon full engagement of housing shell 14 with main housing 12 (FIGS. 10-12).

Figure 13:
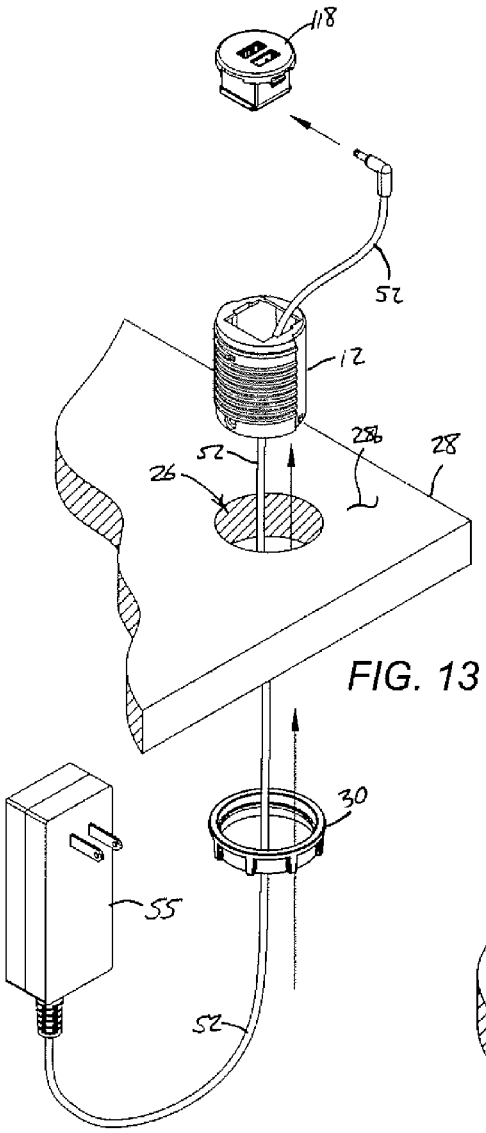
FIGS. 13-19 are perspective views depicting steps of assembling and installing the electrical receptacle assembly of FIG. 2 along a work surface.
Figure 14:
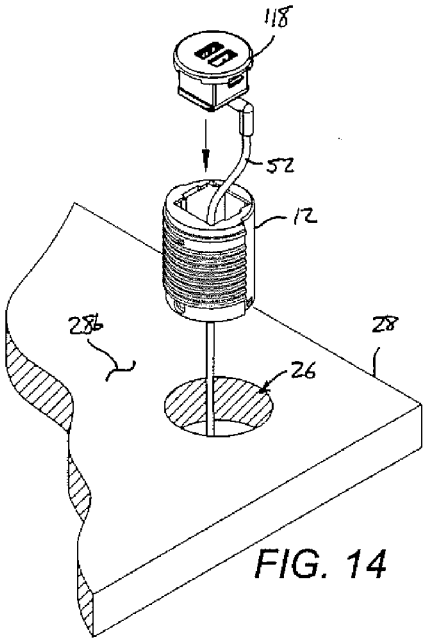
Figure 15:
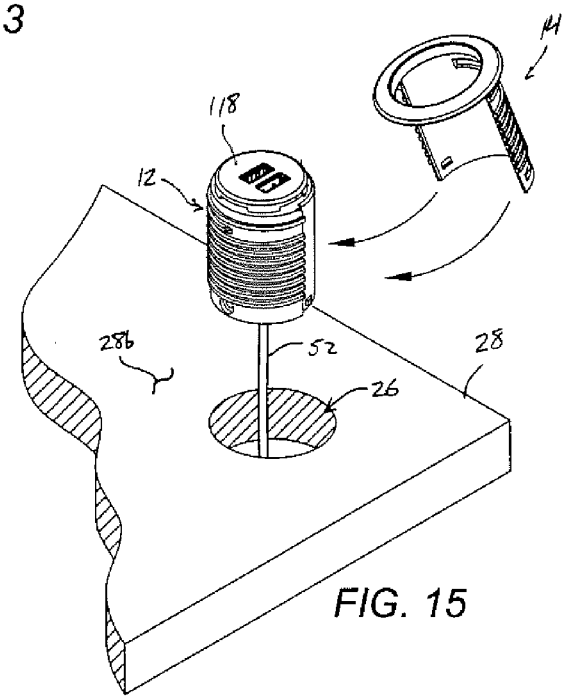

To assemble electrical receptacle assembly 10, lower portion 18*a* of electrical outlet 18 is inserted through opening 20 formed in upper surface 22 of main housing 12, with appropriate wiring (e.g., high voltage power cord 44 or a low voltage wire 52), such as shown in FIGS. 6, 13, and 14, so that electrical outlet 18 rests with its upper portion 18*b* engaging upper surface 22 of main housing 12, such as shown in FIGS. 7 and 15. In the case of a low-voltage DC outlet, such as the USB-style outlet of FIG. 6, low voltage wire 52 is coupled to a coaxial port 53 (FIG. 10) at a lower portion of the outlet 18, and supplied with DC power from a transformer 55 (FIG. 13) at an opposite end of wire 52. Low-voltage DC outlets of this type or more fully described in commonly-owned U.S. patent application, Ser. No. 14/293,198 , filed Jun. 2, 2014 (U.S. Publication No. 2014/0355231), which is hereby incorporated herein by reference in its entirety.

Figure 5C:
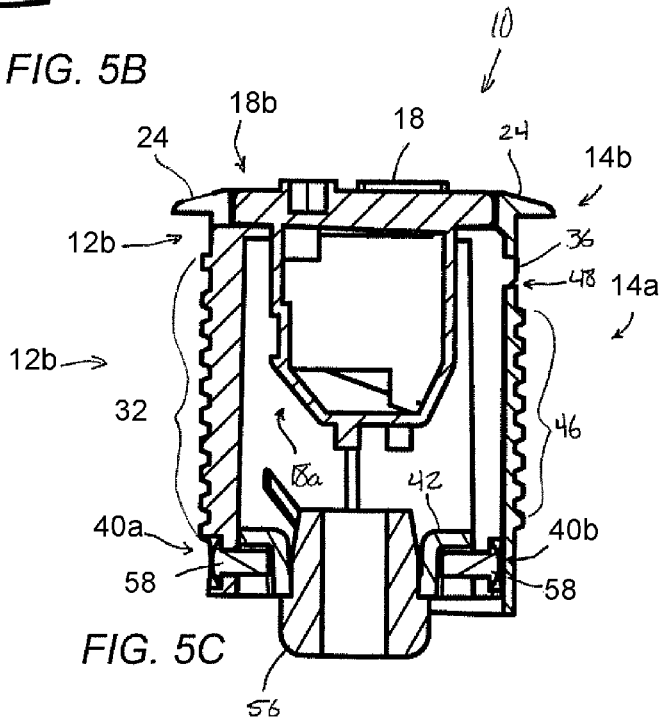
FIG. 5C is a side sectional elevation taken along section line VC-VC in FIG. 5B.

In the illustrated embodiment, electrical outlet 18 includes a pair of ramped latch tabs 54 (FIG. 6) that engage corresponding surfaces defining opening 20 of main housing 12, to at least temporarily secure outlet 18 at main housing 12. Optionally, and particularly when electrical outlet 18 is a high voltage AC outlet, high voltage power cord 44 is passed through a strain relief member 56 at base plate 42, which is then secured at a lower end of the main housing's lower portion 12*a* using rivets 58 or other fasteners disposed through openings 40*a*, 40*b*, where rivets 58 engage receiving areas or recesses 60 of base plate 42, such as shown in FIGS. 5A and 5C.

Figure 3:
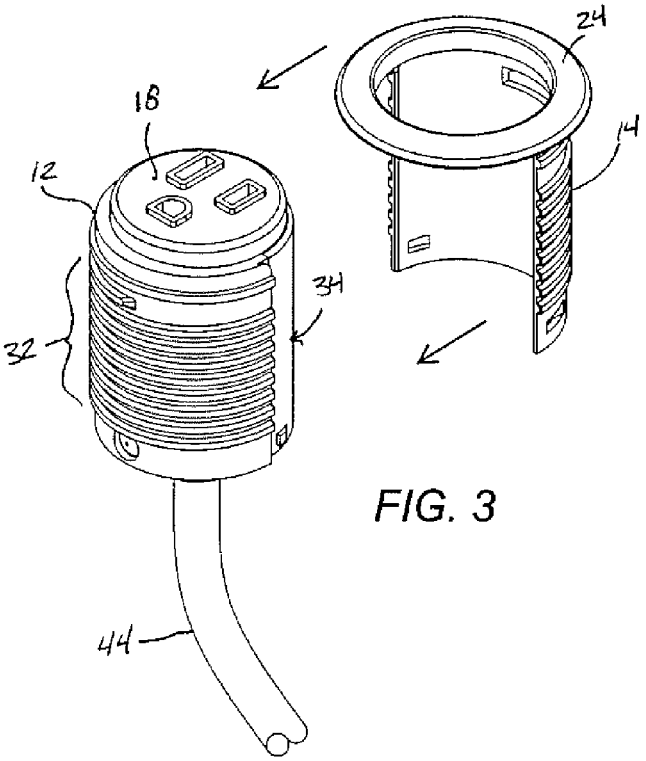
FIG. 3 is a partially exploded perspective view of the electrical receptacle assembly of FIG. 1, depicting a housing shell being attached to a main housing.

Housing shell 14 is then attached to main housing 12, such as in a method illustrated in FIGS. 3, 6, and 15. For example, and with reference to FIG. 15, housing shell 14 may be tilted during an initial engagement of bezel 24 with the upper portion 18*b* of electrical outlet 18 and upper portion 12*b* of main housing 12, and then rotated into alignment with main housing 12 so that tab 36 engages and seats in upper slot 48 and so that ramped latch projections 38 engage the respective lower openings 50 in a snap-fit manner, to thereby secure housing shell to main housing 12. Because housing shell 14 is typically formed from a new somewhat resilient material, housing shell 14 can be subsequently separated from main housing 12 by pulling on housing shell 14 in the vicinity of lower openings 50 in order to disengage the ramped latch projections 38.

Once housing shell 14 and main housing 12 are assembled together, with bezel 24 surrounding the upper end portion 18*b* of the selected electrical outlet 18, the respective lower portions 12*a*, 14*a* of the main housing and housing shell may be inserted through opening 26 formed in surface 28 (FIGS. 16 and 17) at which point threaded collar 30 is coupled to male threaded portions 32, 46, such as shown in FIGS. 17 and 18. Threaded collar 30 is then tightened so that upper surface 30*a* of threaded collar 30 engages a lower surface 28*a* of work surface 28, so that work surface 28 is essentially clamped between threaded collar 30 and a lower surface of bezel 24, such as shown in FIGS. 18 and 19. It will be appreciated that threaded collar 30 also serves to secure housing shell 14 to main housing 12, so that the housing shell 14 cannot be separated from the main housing 12 until the threaded collar 30 is removed.

Electrical receptacle assembly 10 may be readily removed from opening 26 and disassembled, such as for replacement of electrical outlet 18, by generally following a reverse order of steps for attachment and assembly as described above. However, it will be appreciated that when rivets 58 or other fasteners are used to secure base plate 42 at a lower end of main housing 12, it may be necessary to drill out or use a tool to remove the rivets or other fasteners prior to removal of the electrical outlet from the main housing.

Figure 20:
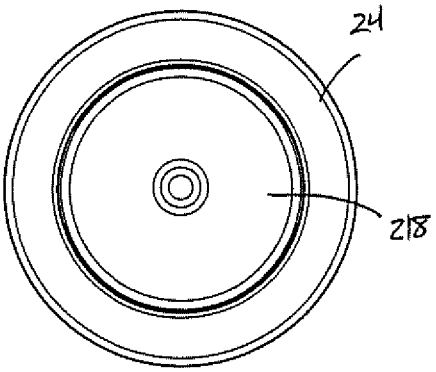
FIGS. 20-25 are top plan views of different configurations of electrical receptacle assemblies in accordance with the present invention.
Figure 21:
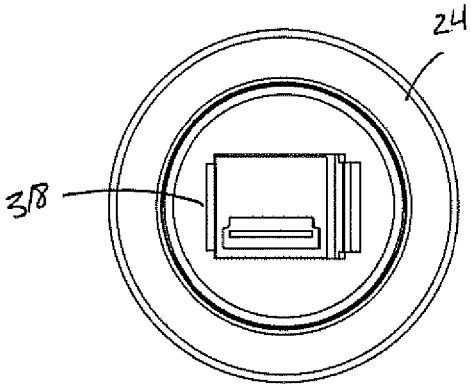
Figure 22:
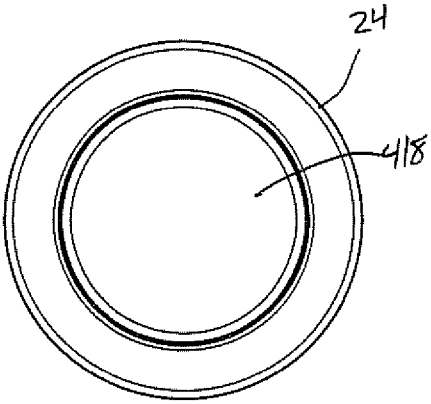
Figure 23:
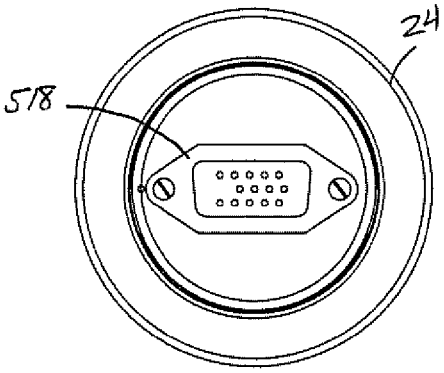
Figure 24:
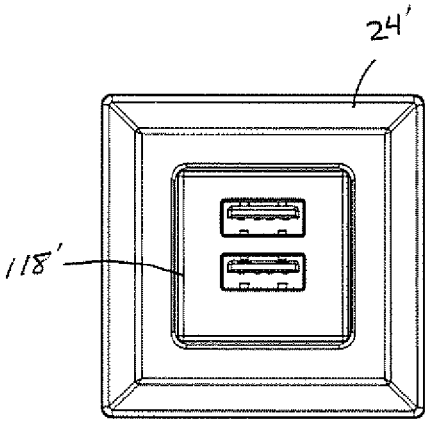
Figure 25:
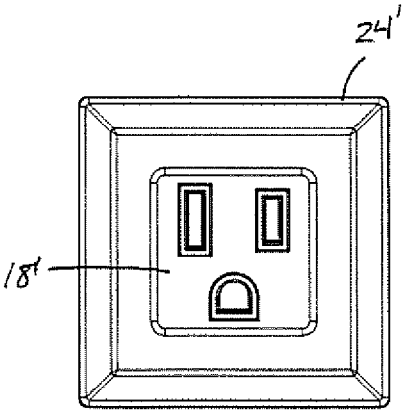
Figure 26:
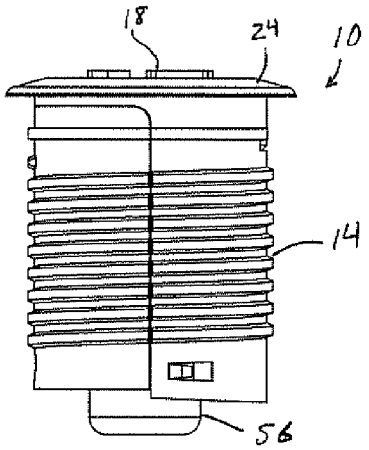
FIG. 26 is a right side elevation of the electrical receptacle assembly of FIG. 1, having its power cord omitted.
Figure 27:
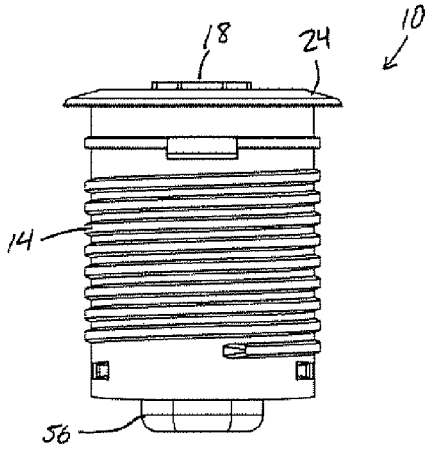
FIG. 27 is a right side elevation of the electrical receptacle assembly of FIG. 26.
Figure 28:
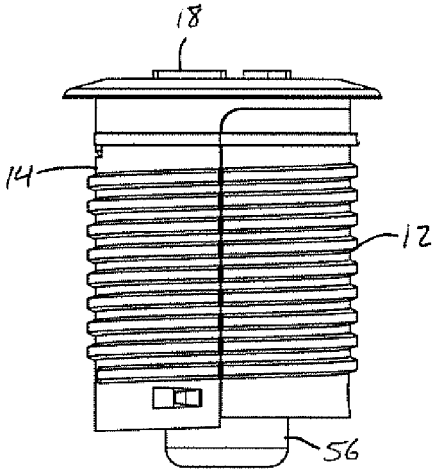
FIG. 28 is a left side elevation of the electrical receptacle assembly of FIG. 26.
Figure 29:
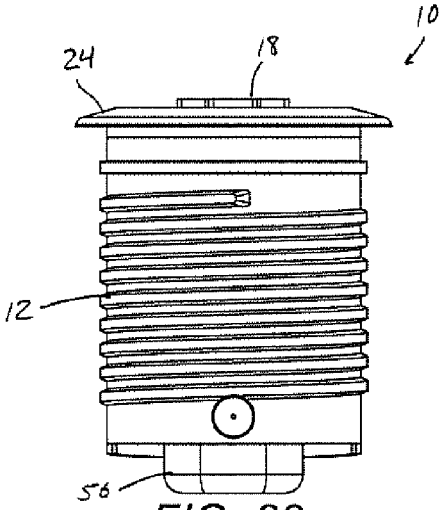
FIG. 29 is a rear elevation of the electrical receptacle assembly of FIG. 26.
Figure 30:
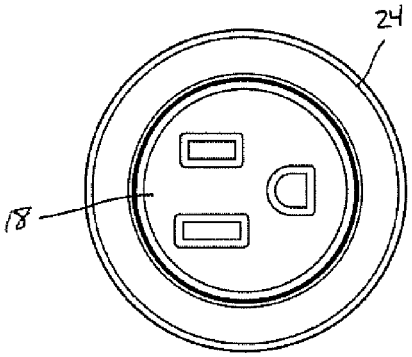
FIG. 30 is a top plan view of the electrical receptacle assembly of FIGS. 26.
Figure 31:
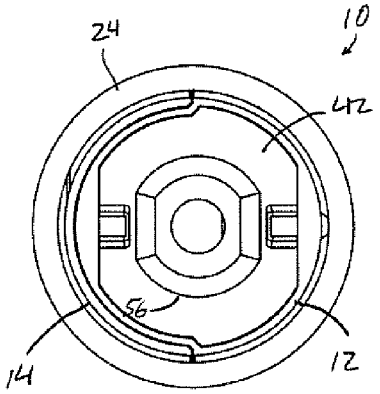
FIG. 31 is a bottom plan view of the electrical receptacle assembly of FIG. 26.

Although electrical outlets 18 are primarily described herein as being either a high voltage AC outlet or a low voltage DC outlet, it will be appreciated that substantially any type of electrical power and/or electronic data or signal outlet or port may be provided at an upper end of electrical receptacle assembly 10, without departing from the spirit and scope of the present invention. For example, electrical receptacle assembly 10 may be fitted with a coaxial low voltage outlet 218 (FIG. 20), an HDMI outlet 318 (FIG. 21), a blank cover 418 (FIG. 22), or a multi-pin video port 518 (FIG. 23). Other types of ports or connectors are also envisioned, such as telephone jacks, Ethernet ports, audio ports, and the like. It will further be appreciated that although the outlets (18, 118, 218, 318, 418, 518) are all shown having a circular outer shape when viewed from above, other shapes are also possible, such as a square dual-receptacle USB-style low voltage DC outlet 118' or a square high voltage AC outlet 18', either of which can be fitted into a square bezel 24' at an upper end of a housing shell, such as shown in FIGS. 24 and 25. FIGS. 26-29 provide four side views of electrical receptacle assembly 10 fitted with high voltage AC outlet 18, while FIGS. 30 and 31 provide top and bottom plan views, respectively.

Accordingly, the present invention provides a convenient electrical power and/or electronic data or signal outlet or port that is readily mountable, de-mountable, and relocatable without tools, and that may further be reconfigured or fitted with a different outlet, in some cases also without tools. The assembly includes two housing portions that assemble together without separate fasteners, and that can support many different types of electrical or data outlets or receptacles so that the assembly is readily reconfigurable and generally does not require substitution of different components to accommodate different receptacles. Thus, the electrical receptacle assembly provides users with convenient access to electrical and/or data outlets at a work surface or the like.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A grommet-style electrical receptacle assembly comprising:

a first housing piece having a first base portion and a first upper portion configured to support an electrical or data outlet;

a second housing piece having a second base portion and a second upper portion, wherein said second base portion is configured to engage said first base portion, and said second upper portion comprises a bezel configured to substantially surround said first upper portion;

wherein one or both of said first and second base portions substantially enclose and define an interior cavity for receiving at least a lower portion of the electrical or data outlet; and a fastener operable to secure said first and second base portions together, and to secure said first and second housing pieces at an opening formed in a work surface with said first and second upper portions disposed at or above the work surface.

2. The electrical receptacle assembly of claim 1, wherein said second upper portion is configured to overlie said first upper portion.

3. The electrical receptacle assembly of claim 1, wherein said first and second housing pieces have a common longitudinal axis when assembled together, and wherein respective substantially vertical edge portions of said first and second base portions are disposed along a common plane that is substantially parallel to said longitudinal axis.

4. The electrical receptacle assembly of claim 1, wherein said first base portion includes a threaded half-cylindrical portion and a non-threaded half-cylindrical portion opposite said threaded half-cylindrical portion, said threaded and non-threaded half-cylindrical portions cooperating to define said interior cavity, and wherein said second base portion includes a threaded half-cylindrical portion configured for positioning around said non-threaded half-cylindrical portion and configured for cooperative alignment with said threaded half-cylindrical portion of said first base portion.

5. The electrical receptacle assembly of claim 4, wherein said fastener comprises a threaded collar for threadedly engaging said threaded half-cylindrical portions of said first and second base portions, said fastener having an upper surface configured to engage a lower surface of the work surface.

6. The electrical receptacle assembly of claim 1, further in combination with the electrical or data outlet, wherein said electrical or data outlet comprises at least one chosen from (i) a 110V AC electrical outlet, (ii) a 220V AC outlet, (iii) a USB connector, and (iv) a low voltage DC outlet.

7. The electrical receptacle assembly of claim 1, wherein said first housing piece comprises a first alignment element and said second housing piece comprises a second alignment element, wherein said first alignment element is configured to engage said second alignment element during engagement of said second housing piece with said first housing piece.

8. The electrical receptacle assembly of claim 7, wherein said first alignment element comprises a projection and said second alignment element comprises a recess or opening.

9. The electrical receptacle assembly of claim 7, wherein said first housing piece comprises a first latching element and said second housing piece comprises a second latching element, wherein said first latching element is configured to engage said second latching element to thereby releasably secure said second housing piece to said first housing piece during engagement of said second housing piece to said first housing piece.

10. The electrical receptacle assembly of claim 9, wherein said first latching element comprises at least one ramped latch projection, and said second latching element comprises at least one recesses or opening.

11. An electrical receptacle assembly for mounting at an opening in a work surface, said electrical receptacle assembly comprising:

a two-piece housing including a main housing and a housing shell, each of said main housing and said housing shell comprising a respective outer surface portion;

said main housing defining an interior cavity and an outlet opening, said outlet opening configured to engage and support an electrical or data outlet, and said interior cavity configured to receive at least a lower portion of the electrical or data outlet;

said housing shell coupled to said main housing and disposed around at least a portion of said interior cavity;

wherein said respective outer surface portions of said main housing and said housing shell cooperate to form an outer surface of said two-piece housing that is configured for insertion into the opening in the work surface; and a fastener configured to engage said outer surface of said two-piece housing and the work surface, and operable to selectively secure said electrical receptacle assembly to the work surface.

12. The electrical receptacle assembly of claim 11, wherein said housing shell comprises an upper bezel disposed generally around said outlet opening of said main housing.

13. The electrical receptacle assembly of claim 11, wherein each of said outer surface portions of said main housing and of said housing shell comprise respective partial male threads, and wherein when said housing shell is coupled to said main housing, said partial male threads cooperate to define a substantially continuous male thread around said outer surface of said two-piece housing.

14. The electrical receptacle assembly of claim 13, wherein said fastener comprises a threaded collar for threadedly engaging said substantially continuous male thread, said threaded collar having an upper surface configured to engage a lower surface of the work surface.

15. The electrical receptacle assembly of claim 13, wherein said main housing comprises a smooth partial-cylindrical outer surface portion opposite said partial male threads.

16. The electrical receptacle assembly of claim 15, further comprising a first alignment element at said smooth partial-cylindrical outer surface portion and a second alignment element at said main housing, wherein said first alignment element is configured to engage said second alignment element during coupling of said housing shell to said main housing.

17. The electrical receptacle assembly of claim 16, wherein said first alignment element comprises a projection and said second alignment element comprises a recess or opening.

18. The electrical receptacle assembly of claim 16, further comprising a first latching element at said smooth partial-cylindrical outer surface portion and a second latching element at said main housing, wherein said first latching element is configured to engage said second latching element to thereby releasably secure said housing shell to said main housing during coupling of said housing shell to said main housing.

19. The electrical receptacle assembly of claim 18, wherein said first latching element comprises a pair of ramped latch projections and said second latching element comprises a pair of recesses or openings.

20. The electrical receptacle assembly of claim 11, further in combination with the electrical or data outlet, wherein said electrical or data outlet comprises at least one chosen from (i) a 110V AC electrical outlet, (ii) a 220V AC outlet, (iii) a USB connector, and (iv) a low voltage DC outlet.

* * * * *